United States Patent [19]

Shepherd et al.

[11] Patent Number: 4,717,281

[45] Date of Patent: Jan. 5, 1988

[54] ROAD MARKER SYSTEM AND METHOD OF INSTALLATION

[76] Inventors: Kathleen P. Shepherd; Tobin Djerf, both of 401 E. Madison, Port Isabel, Tex. 78578

[21] Appl. No.: 917,433

[22] Filed: Oct. 10, 1986

[51] Int. Cl.[4] ..... E01F 9/06

[52] U.S. Cl. ..... 404/16; 404/9; 116/63 R; 350/104; D10/113

[58] Field of Search ..... 404/9, 10, 12, 14–16; 116/63 R; 350/97, 103–109; D10/113

[56] References Cited

U.S. PATENT DOCUMENTS

| | | | |
|---|---|---|---|
| 2,666,373 | 1/1954 | Mattson | 404/16 |
| 3,392,639 | 7/1968 | Heenan et al. | 404/12 |
| 3,516,337 | 6/1970 | Gubela | 404/9 |
| 3,693,511 | 9/1972 | Medynski | 404/16 X |
| 3,971,623 | 7/1976 | Hedgewick et al. | 404/12 X |
| 3,975,108 | 8/1976 | Suhr et al. | 404/16 |
| 3,980,393 | 9/1976 | Heasley et al. | 404/12 X |
| 4,129,397 | 12/1978 | Eigenmann | 404/14 |
| 4,232,979 | 11/1980 | Johnson, Jr. et al. | 404/16 |
| 4,557,624 | 12/1985 | Walker | 404/16 X |

FOREIGN PATENT DOCUMENTS

| | | | |
|---|---|---|---|
| 2140850 | 12/1984 | United Kingdom | 404/11 |

*Primary Examiner*—Stephen J. Novosad
*Assistant Examiner*—John F. Letchford
*Attorney, Agent, or Firm*—Ronald B. Sefrna

[57] ABSTRACT

A road marker having a stiff but resilient body including a cavity formed therein to receive a suitable adhesive material for securing the marker to the road surface, and adaptable for the inclusion of one or more apertures in said body to receive one or more hermetically sealed lens and retro-reflector elements prior to adhesion of the road marker to the roadway. The body of the road marker is formed with a continuous edge portion and a frusto-conical central portion configured so as to limit contact between vehicle tires and the outer lens surface which may be disposed therein, thereby limiting abrasion and extending the useful life of the road marker. The body of the road marker also includes an aperture to receive a nail in order to facilitate installation of the road marker on the road surface.

25 Claims, 7 Drawing Figures

ROAD MARKER SYSTEM AND METHOD OF INSTALLATION

FIELD OF THE INVENTION

The invention relates generally to road marker devices, and relates more specifically to a system of resilient-bodied road marker devices adapted to receive hermeticallly sealed lens and retro-reflector elements, and to a method of installation of the road marker devices on the roadway.

BACKGROUND OF THE INVENTION

It has for some time been common practice to employ both reflective and non-reflective roadway markers adhered to the roadway surface to delineate traffic lanes and other traffic flow patterns. Because such road markers are disposed directly upon the road surface they are subjected to frequent direct impacts from the tires of vehicular traffic, necessitating that such road markers be constructed of high strength, impact resistance material. This criteria has been typically met by utilizing road marker bodies of ceramic or rigid plastic construction, often filled with epoxy resins or similar materials. Such an approach to road marker construction is exemplified by U.S. Pat. No. 3,392,639. Such rigid road marker bodies have had several disadvantages, most notably a tendency to fracture upon repeated impact by vehicular traffic. Such road marker bodies may fracture into several pieces and lose adhesion to the road surface, creating a risk of serious damage or injury if such pieces are thrown by the wheels of passing vehicles.

Another approach which has been attempted in the prior art has been construction of road marker bodies of a soft rubber or rubber-like material, as exemplified by U.S. Pat. No. 3,693,511, in an effort to alleviate the disadvantages associated with hard, rigid road marker bodies. While such an approach is effective in avoiding the problems of road marker body fracture, soft rubber or rubber-like road marker bodies are themselves subject to certain disadvantages. Excessively soft and flexible read marker bodies are subject to deformation leading to release of retroreflector elements from such bodies, with corresponding loss of road marker function. In addition, such materials may suffer accelerated deterioration when exposed to the effects of intense sunlight and of wide ranges of cyclic variation in ambient temperature.

In order to provide a retroreflextive road marker readily visible during periods of darkness it has been common practice to incorporate one or more reflective elements and glass or plastic lenses into the road marker body. Both separated reflective elements and lenses and unitary reflector-lens combinations have been used in the prior art, as illustrated by U.S. Pat. No. 3,971,623 and U.S. Pat. No. 3,392,639, respectively. In many situations it is common to utilize reflective elements of different colors, and in some instances to utilize different colors on opposite sides of the same road marker. It has also been common to utilize road marker bodies of differing colors. Most road markers in the prior art have the retroreflective elements incorporated into the road marker body during construction, requiring the maintenance of relatively large inventories of road markers of the various combinations used.

In addition to this disadvantage, road markers in common use have enjoyed relative short effective life spans due to either failure of the road marker body or, more typically, deterioration of reflective qualities resulting from incursion of water and other contaminants, the effects of sunlight, and abrasion of the outer lens surface from vehicular impact. These problems have necessitated frequent removal of deteriorated road markers and their replacement with new road markers, an expensive and labor intensive process.

From the foregoing, it will be apparent that there has been a need for a road marker system which alleviates the problems and disadvantages of maintenance of large inventories of road markers of differing types, of short effective life span, and of the labor intensive nature of road marker installation.

SUMMARY OF THE INVENTION

The present invention overcomes the major disadvantages of the prior art by providing a stiff by resilient road marker body adapted to receive interchangeable hermetically sealed retroreflector and lens elements, of such design that the exposed lens surface, when inserted in the road marker body, is substantially protected from direct vehicular impact. The present invention further provides a method of road marker installation which results in the bonding of the retroreflector and lens element with the body of the road marker and facilitates the adhesion of the road marker to the road surface.

The road marker generally comprises a resilient body having cavities therein, including a continuous peripheral rim, a planar peripheral surface, and a frusto-conical central portion, all mutually concentric about the central axis of the body. The road marker body further includes a shallow inner base cavity of modified torroidal shape, open at its bottom surface. The frusto-conical portion of the road marker body includes apertures on opposing sides thereof, extending into the body of the road marker and connecting with the shallow base cavity in the interior of the body. A plurality of cylindrical cavities extend into the frusto-conical portion of the body from the upper surface of the shallow base cavity in a direction parallel to the central axis of the road marker body. The body is further penetrated by a central aperture coaxially aligned with the central axis of the body, to receive a nail which will extend into the road surface upon which the road marker is to be installed.

The road marker of this invention further comprises retroreflector and lens elements to be received in the apertures formed in the frusto-conical portion of the road marker body. Such elements include a shell-like body having a rear wall, two side walls, a top wall, a curved and angled front wall, and a dividing wall intermediate the rear wall and the front wall. Retroreflective means is disposed in the front chamber of the element body and attached to the inner surface of the front wall of that body. The front chamber is filled with a suitable potting compound to fully seal that chamber and prevent incursion of contaminants. Element bodies are then inserted into the apertures in the frusto-conical portion of the road marker body until the outer surface of the front wall of each element body is flush with the outer surface of that frusto-conical portion.

The insertion of such element bodies into the road marker body may be performed immediately prior to installation of the road marker on the road surface, allowing use of a generic road marker body with various combinations of retroreflector color. After insertion of the retroreflector and lens elements into the body of the road marker, the road marker is inverted and the cavities therein, including the rear chambers of the retroreflector and lens elements, are filled with a suitable adhesive compound. The road marker is then placed with its base and the contained adhesive in contact with the road surface and affixed thereto by driving a nail through the central aperture in the road marker body and into the road surface.

These and other features and advantages of the present invention will now be disclosed in greater detail with reference to the accompanying drawing figures, wherein

DETAILED DESCRIPTION OF THE INVENTION

Figure 1:
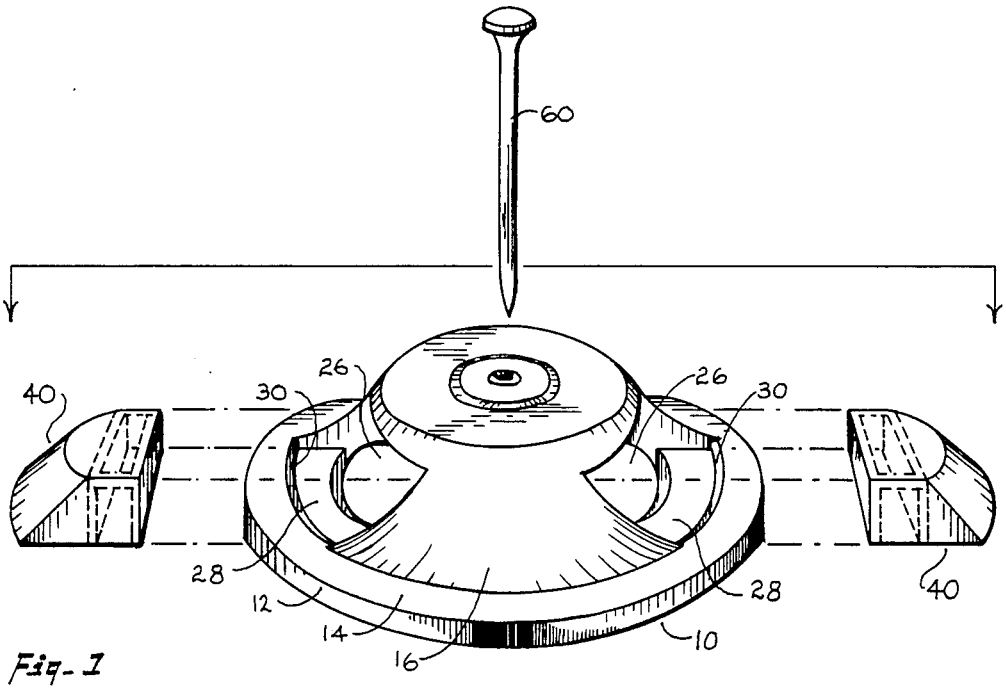
FIG. 1 is an exploded perspective view of the major components of the system of the invention.
Figure 2:
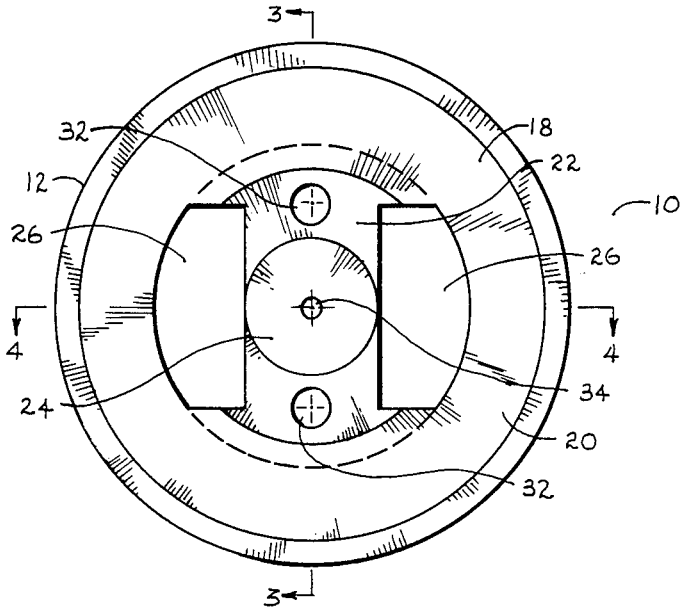
FIG. 2 is an inverted plan view of the road marker body of the invention.
Figure 3:
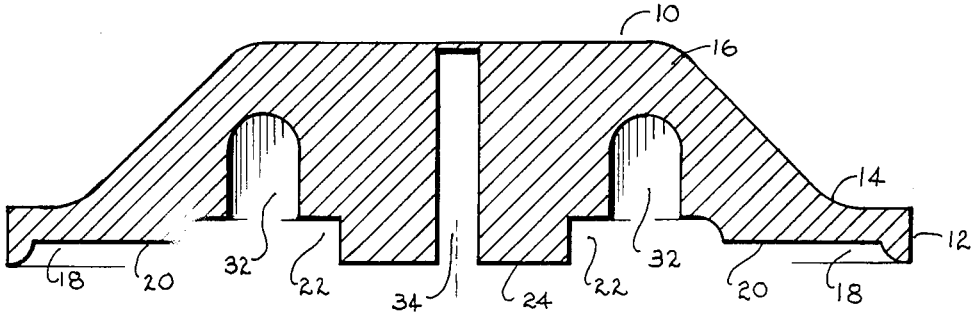
FIG. 3 is a sectional elevation view of the road marker body of the invention along line 3—3 of FIG. 2.
Figure 4:
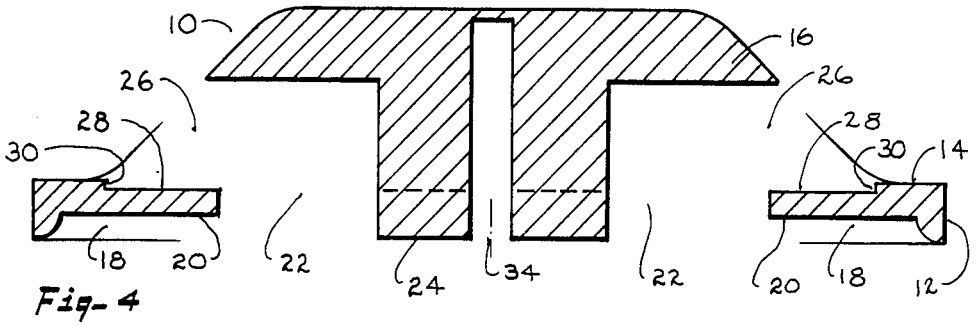
FIG. 4 is a sectional elevation view of the road marker body of the invention along line 4—4 of FIG. 2.

With reference to FIG. 1, it will be seen that the preferred embodiment of the road marker system of this invention generally comprises road marker body 10, retroreflector and lens elements 40, and nail 60 as its major components. Each component will be described, followed by a description of the method of use and installation of such road marker system on the roadway.

Referring principally now to FIG. 1 through FIG. 4, road marker body 10 is preferably molded of a stiff by resilient material as a unitary or one piece construction. Body 10 includes continuous peripheral rim 12, planar peripheral surface 14, and frusto-conical central portion 16, all mutually concentric about the central axis of body 10. The relation between the width of planar peripheral surface 14 and the height of frusto-conical central portion 16 above such surface is such that a plane intersecting the outer edge of the upper surface of frusto-conical portion 16 and the outer edge of peripheral planar surface 14 does not intersect any portion of the inclined surface of such frusto-conical portion. By virtue of this design element, the impact of vehicle tires upon road marker body 10 will be largely confined to such edges and impact upon the inclined surface of such frusto-conical portion of the road marker body will be reduced or eliminated. As hereinafter described, the lens surfaces of retroreflector and lens elements 40 will be disposed flush with such inclined surface. The minimization or elimination of tire impact thereon results in a substantial reduction in lens surface abrasion with a corresponding increase in useful road marker life span.

Body 10 is formed to provide an inner base cavity comprising two portions; an outer torroidal portion 18 bordered on its outer edge by the lower inner surface of continuous peripheral rim 12 and on its top by surface 20 and a continuous inner torroidal portion 22 which extends farther into the interior of body 10 and surrounds inner support 24.

Frusto-conical portion 16 of body 10 includes apertures 26 extending laterally into body 10 in opposing relationship about a common longitudinal axis perpendicular to the central axis of body 10. Apertures 26 receive retroreflector and lens elements 40 and are configured to receive such elements in close mating relationship. Apertures 26 extend downward a short distance into the planar peripheral portion 14 of body 10 to provide retroreflector and lens element support surfaces 28 and retaining lips 30. The parts of such apertures 26 inward from the inner edges of element support surfaces 28 are contiguous to and coextensive with inner portion 18 of the inner base cavity of body 10. Additional apertures 32 extend into body 10 from the upper surface of the inner portion 18 of the base cavity of body 10 toward the top surface of frusto-conical portion 16. The longitudinal axes of apertures 32 are parallel to the central axis of body 10 and are contained in a plane perpendicular to the longitudinal axis of apertures 26. Body 10 is fully penetrated by central aperture 34, coxially aligned with the central axis of body 10, which will receive nail 60 during installation of the road marker on the road surface.

Road marker body 10 is preferably molded as a one-piece construction of thermoplastic elastomer material of sufficient strength and durability to withstand repeated vehicular impacts without destruction or loss of integrity. The material of construction should also be sufficiently resilient to cushion or absorb the force produced by vehicular impact with sufficient stiffness to avoid excessive deformation detrimental to maintenance of the structural integrity of road marker components and the adhesive bond among such components and between the road marker and the roadway upon which it is installed. The material of construction should still further be capable of maintaining the desirable characteristics of resilience, strength, and durability though the range of variation of ambient temperatures to which the installed road marker may be subjected. It has been found that a polyester elastomer, such as that produced under the trade name Hytrel, having a Shore hardness of 90A or 55D provides suitable characteristics within such criteria. Road marker body 10 may be colored to meet usage criteria, preferably by full integration of a color additive into the construction material prior to molding, providing full color penetration.

Figure 5:
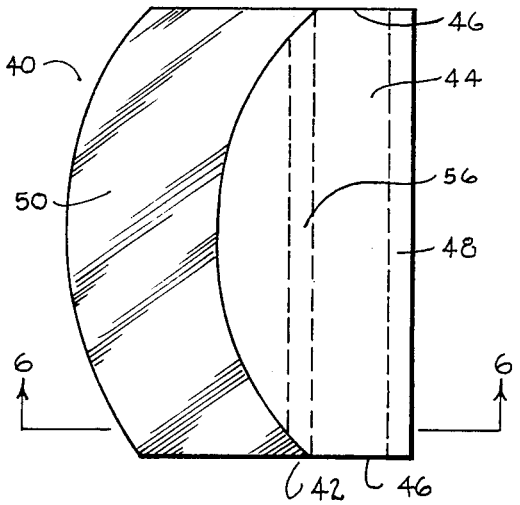
FIG. 5 is an inverted plan view of the retroreflector and lens element of the invention, with potting compound omitted.
Figure 6:
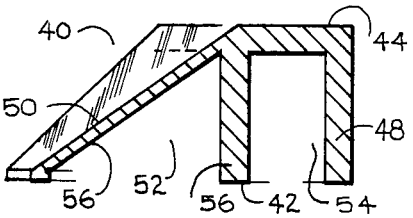
FIG. 6 is a sectional elevational view of the retroreflector and lens element of the invention, with potting compound omitted, along line 6—6 of FIG. 5.

Referring now to FIG. 5 and FIG. 6, retroreflector and lens elements 40 will be seen to each comprise a shell-like body 42, having a top wall 44, side walls 46, rear wall 48, and lens 50 as the front wall. Element body 42 is open at its bottom wall and is divided into front chamber 52 and rear chamber 54 by dividing wall 56, disposed intermediate rear wall 48 and lens 50 and parallel to rear wall 48. The outer surface of lens 50 will lie flush with the outer inclined surface of frusto-conical portion 16 of road marker body 10, and is of the same inclined convex curvature. Lens 50 is preferably thinner in cross-section than walls 44, 46, 48, and 56, so as to maximize transmission of both incident and retroflected light while maintaining the structural integrity of element body 42. Element body 42 is preferably of molded one piece construction from a rigid, abrasion resistant transparent material. In the preferred embodiment, element body 42 is constructed of Lexan (TM) polycarbonate, but any other material of suitable characteristics may be used. The outer surface of lens 50 is preferably coated with an abrasion resistant silicone material. Such coating may be applied in liquid form, and subsequently cured to a hard solid state.

Retroreflector and lens element 40 further includes retroreflector means 56 disposed in front chamber 50 with its front or outer surface in full mating relationship with the inner surface of lens 50. In the preferred embodiment retroreflector means 56 comprises a colored metalic tape and is attached to the inner surface of lens 50 with a transparent ultra violet radiation absorbing adhesive compound. Use of an ultra violet radiation compound is preferred in order to minimize the deteriorating effects of sunlight on retroreflector means 56 and extend its useful life span. However, alternate embodiments of a retroreflector means known in the prior art may be effectively utilized, such as a molded array of prismatic reflector units.

The remainder of front chamber 52 is filled with a suitable potting compound which cures to a hard, rigid material, providing a hermetic seal against incursion of water and other contaminants in order to prevent fogging and chemical deterioration of lens 50 and retroreflector means 56, as well as increasing the strength of retroreflector and lens element 40.

Figure 7:
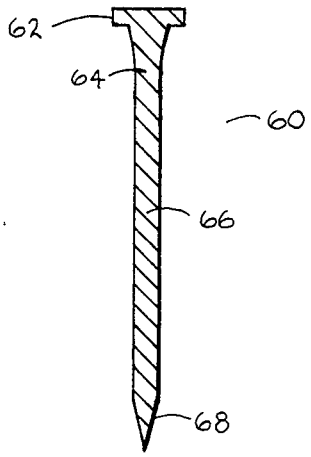
FIG. 7 is an elevation view of the nail of the present invention.

Nail 60, the third major component of the road marker system, will be seen from FIG. 7 to comprise head 62, transition zone 64, shaft 66 and point 68. Shaft 66 has a diameter essentially equal to the diameter of central aperture 34 in road marker body 10, and is of sufficient length to fully penetrate body 10 through central aperture 34 and extend into the road surface a sufficient distance to firmly anchor the road marker thereto. The length of shaft 66 may be varied to accomodate anchoring in different types of road surfaces. Head 62 is of sufficiently larger diameter than shaft 66 and central aperture 34 as to retain road marker body 10 in firm contact with the road surface. Transition zone 64, an inverted frusto-conical section, is designed to penetrate into the upper segment of central aperture 34, thus increasing the frictional resistance against movement of road marker body 10 relative to nail 60, and providing a larger effective retention surface area. Shaft 66 tapes smoothly to point 68 in order to facilitate penetration of nail 60 into the road surface.

The method of use of the road marker system of the present invention comprises the general steps of inserting retroreflector and lens elements 40 into road marker body 10; inverting the thus completed road marker and filling rear segments 54 of elements 40, apertures 32 and portions 18 and 22 of the inner base cavity with a suitable adhesive compound; reinverting the adhesive filled road marker and placing it in the desired location on the road surface; introducing nail 60 into central aperture 34; and driving nail 60 through such aperture and into the road surface until the lower surface of head 62 is in firm contact with the upper surface of frusto-conical portion 16 of the road marker and the road marker base is in firm contact with the road surface. As the adhesive compound cures an internal interlock is formed between road marker body 10 and retroreflector and lens elements 40 by virtue of the internal communication between road marker body internal cavities and rear chambers 54 of the retroreflector and lens elements. In similar fashion, the extension of adhesive compound into apertures 32 of the road marker body serves to increase adhesion between road marker and road surface. Use of nail 60 to attach the road marker to the road surface provides initial stabilization of the road marker on the road surface during curing of the adhesive compound; maintains pressure between road marker, adhesive, and road surface during curing of the adhesive compound; and serves as an additional attachment means during the life of the road marker, minimizing the possibility of dislocation. It will, however, be understood that use of nail 60, while facilitating installation of the combined road marker body and retroreflector and lens elements, may be omitted without departing from the scope and spirit of the invention.

It will be apparent that retroreflector means of various colors may be utilized in the construction of retroreflector and lens elements 40 in order to achieve reflection of light of a selected color in order to meet use criteria. Because road marker body 10 and retroreflector and lens elements 40 are designed to be separately formed and then combined to produce a completed road marker, it will also be apparent that a wide variety of completed road marker configurations can be achieved from a limited variety of individual components. For example, an inventory of road marker bodies in two colors and of retroreflector and lens elements in three colors allows combination of these elements into twelve distinct completed road marker configurations.

The road marker system of the present invention may be readily adapted to provide a unidirectional retroreflective road marker or a non-reflective road marker by omitting one or both of apertures 26, respectively, in the forming of road marker body 10, and the corollary omission of one or both of retroreflector and lens elements 40 from the completed road marker. Alternatively, a unidirectional retroreflective road marker or non-reflective road marker may be provided by forming body 10 as previously described and replacing one or both of retroreflector and lens elements 40 in the completed road marker with suitably colored non-reflective inserts of the same gross configuration and size as the retroreflector and lens elements 40 previously described. Such inserts may be constructed by omission of retrorelfective means 56 from elements 40 and filling of front chamber 52 with a suitably colored potting compound, or by monolithically forming such inserts from the same material utilized for construction of the road marker body.

It is apparent that the present invention is well adapted to obtain the advantages and features set forth, together with other advantages which will become obvious to one skilled in the relevant art. The foregoing disclosure of the invention is only illustrative and explanatory, and the invention admits of changes in size, shape, and composition of its components without departing from the scope and spirit thereof.

What is claimed is:

1. A road marker comprising:

a stiff resilient unitary body having a central vertical axis;

a planar peripheral portion;

a central frusto-conical portion mutually concentric with said planar peripheral portion about said central vertical axis of said body;

one or more open cavities extending into the interior of said body from the base thereof;

one or more apertures extending from the outer surface of said central frusto-conical portion into the interior thereof, having one or more longitudinal axes perpendicular to said central vertical axis of said body, and being in interconnection with one or more of said open cavities;

one or more elements to be received in said one or more apertures, each having a shell-like body with at least one top wall, one rear wall, two side walls and one front wall; and one or more open chambers extending into said shell-like body from the base thereof.

2. The road marker of claim 1 wherein said stiff resilient unitary body is molded from a thermoplastic elastomer material.

3. The road marker of claim 1 wherein said stiff resilient unitary body is molded from a polyester elastomer having a Shore hardness in the range of 90A to 55D.

4. The road marker of claim 1 wherein said elements are constructed of the same material and are of the same color as said stiff resilient body.

5. The road marker of claim 1 wherein said elements comprise:

a substantially hollow shell-like body of transparent material having a top wall, a rear wall, two opposed side walls, a lens also serving as a front wall, and a dividing wall disposed in said shell-like body intermediate said rear wall and said lens;

a front chamber and a rear chamber in said shell-like body defined by said walls, and open at the base, said front chamber being bordered at the front by said lens and at the rear by said dividing wall, and said rear chamber being bordered at the front by said dividing wall and at the rear by said rear wall;

retroreflector means disposed in said front chamber and adhered to the inner surface of said lens; and potting compound filling the remainder of said front chamber, hermetically sealing said chamber, said retroreflector means and the inner surface of said lens against incursion of water and other contamininants.

6. A road marker system comprising:

a stiff resilient unitary body formed of thermoplastic elastomer material having a central vertical axis;

a continuous peripheral rim;

a planar peripheral portion;

a central frusto-conical portion mutually concentric with said continuous peripheral rim and said planar peripheral portion about said central vertical axis of said body;

an inner cavity extending into the interior of said body, bordered on its outer edge by the inner surface of said continuous peripheral rim, and open at its base;

a plurality of vertical apertures extending into the interior of said frusto-conical portion of said body from said inner cavity, and having longitudinal axes parallel to said central vertical axis of said body; and one or more horizontal apertures extending into said frusto-conical portion of said body from the outer surface of said frusto-conical portion, having longitudinal horizontal axis or axes perpendicular to said central vertical axis of said body, said horizontal apertures also extending downward into said planar peripheral portion of said body a short distance to provide a shallow retaining lip, with the inner portion of said horizontal apertures in interconnection with said inner cavity;

one or more elements to be received in said one or more horizontal apertures, each of said elements having an element body including a planar top surface, a planar rear surface, two opposing planar side surfaces, a planar base, and an inclined, curved front surface with the same angle of inclination and curvature relative to the plane of the top surface of said element body as the outer surface of said frusto-conical portion of said road marker body bears relative to the plane of the top surface of said frusto-conical body; and an open chamber extending into said element body from the base thereof, disposed in said body near the rear surface thereof, such that the interior of said chamber is in interconnection with said inner cavity of said road marker body when said element is recieved in one of said horizontal apertures of said road marker body.

7. The road marker system of claim 6 wherein said stiff resilient unitary body is constructed of a polyester elastomer having a Shore hardness in the range of 90A to 55D.

8. The road marker system of claim 6 wherein said stiff resilient body is colored by inclusion of a color additive in said thermoplastic elastomer material prior to formation of said body.

9. The road marker system of claim 6 wherein said stiff resilient body further includes a central vertical aperture penetrating said body, coaxially aligned with the central vertical axis of said body; and said road marker system further includes a nail to be received in said central vertical aperture and driven into the road surface upon which the road marker is to be installed.

10. The road marker system of claim 6 wherein said element body of each of said one or more elements is constructed of a rigid substantially transparent material;

said element body of each of said one or more elements further includes one or more additional chambers extending into said element body from the base thereof, with one of said additional chambers disposed in said body near the inclined, curved front surface thereof and shaped such that the portion of said element body separating said additional chamber from said inclined curved front surface of said element body is a front wall of uniform composition and thickness;

each of said one or more elements further includes retroreflector means disposed in said additional chamber and firmly adhered to the inner surface of said front wall, and potting compound filling the remainder of said additional chamber flush with the base of said element body, hermetically sealing said additional chamber, said retroreflector means and the inner surface of said front wall; and each of said one or more elements further includes an abrasion resistant substantially transparent coating applied to said inclined, curved front surface of said element body.

11. The road marker system of claim 10 wherein said retroreflector means comprises metallic reflector tape.

12. The road marker system of claim 10 wherein said rigid substantially transparent material is a polycarbonate, said abrasion resistant substantially transparent coating is a silicone material.

13. The road marker system of claim 10 wherein said retroreflector means comprises a molded array of prismatic reflectors.

14. A retroreflective road marker system comprising:

a stiff resilient colored body molded as a one-piece construction of a thermoplastic elastomer material having a central vertical axis;

a continuous peripheral annular rim;

a planar peripheral ring extending inward from said continuous peripheral annular rim toward said central vertical axis of said body and mutually concentric with said rim;

a central frusto-conical portion mutually concentric with said continuous peripheral annular rim and with said planar peripheral ring about said central vertical axis of said body;

a first inner base cavity of generally torroidal shape extending into the interior of said body, bordered on its outer edge by the inner surface of said continuous peripheral annular rim, and open at its base;

a second inner base cavity of generally torroidal shape extending farther into the interior of said body than said first inner base cavity, bordered on its outer edge by the inner edge of said first inner base cavity;

a plurality of vertical apertures extending into the interior of said frusto-conical portion of said body from said second inner base cavity, and having longitudinal axes parallel to said central vertical axis of said body;

a central vertical aperture penetrating said body, and coaxially aligned with said central vertical axis of said body; and a plurality of horizontal apertures each extending into said frusto-conical portion of said body from the outer surface thereof and extending downward a short distance into said planar peripheral ring to provide a shallow retaining lip and an element support surface, with the inner portion of each of said apertures in interconnection with said second inner base cavity;

a plurality of retroreflector and lens elements to be received in said horizontal apertures, each of said elements including a substantially hollow, rigid shell-like body formed of substantially transparent material, having a planar top wall, a planar rear wall, two opposing planar side walls, and an inclined, curved lens serving as a front wall, with said inclination and curvature matching the inclination and curvature of the outer surface of said frusto-conical portion of said still resilient body such that the outer surface of said lens is flush with the outer surface of said frusto-conical portion when said retroreflector and lens element is received in one of said horizontal apertures, and a dividing wall intermediate said rear wall and said inclined, curved lens;

a rear chamber in said shell-like body, open at its base and bordered by said rear wall and said dividing wall at its rear and front, respectively;

a front chamber in said shell-like body, open at its base and bordered by said dividing wall and by said inclined, curved lens at its rear and front, respectively;

retroreflector means disposed in said front chamber with the front surface of said retroreflector means being in firm contact with the inner surface of said inclined, curved lens so as to provide a substantially uninterrupted optical interconnection therebetween;

potting compound filling the remainder of said front chamber hermetically sealing said chamber, said retroreflector means, and the inner surface of said inclined, curved lens; and a substantially transparent abrasion resistant coating applied to the outer surface of said inclined, curved lens; and attachment means to be received in said central vertical aperture in said stiff resilient body and driven into the road surface to which said stiff resilient body is to be attached, comprising a planar head portion;

an inverted frusto-conical portion integrally interconnected to the lower surface of said planar head portion and concentric therewith about the longitudinal axis of said attachment means;

an elongate shaft portion integrally interconnected to the lower surface of said inverted frustoconical portion, and mutually concentric with said inverted frusto-conical portion and said planar hear portion about the longitudinal axis of said attachment means; and a point formed at the end of said elongate shaft portion opposite its integral interconnection to said inverted frusto-conical portion, to facilitate driving of said attachment means into the road surface.

15. The retroreflective road marker system of claim 14 wherein said thermoplastic elastomer material has a Shore hardness in the range of 90A to 55D.

16. The retroreflective road marker system of claim 14 wherein said thermoplastic elastomer material is a polyester elastomer.

17. The retroreflective road marker system of claim 14 wherein said substantially hollow, rigid shell-like body of said retroreflector and lens elements is formed of a polycarbonate material.

18. The retroreflective road marker system of claim 14 wherein said substantially transparent abrasion resistant coating applied to the outer surface of said inclined, curved lens is a silicone material.

19. The retroreflective road marker system of claim 14 wherein the number of said horizontal apertures extending into said frusto-conical portion of said body is two, and the number of said retroreflector and lens elements to be received therein is two, providing a bidirectional retroreflective road marker.

20. The retroreflective road marker system of claim 14 wherein the number of said horizontal apertures extending into said frusto-conical portion of said body is one, and the number of said retroreflector and lens elements to be received therein is one, providing a unidirectional retroreflective road marker.

21. The retroreflective road marker system of claim 14 wherein said retroreflector means comprises a colored metallic tape.

22. The retroreflective road marker system of claim 14 wherein said retroreflector means comprises a molded array of prismatic reflectors.

23. The retroreflective road marker system of claim 14 wherein said attachment means is a metallic nail and the surface of said elongate shaft portion thereof is smooth.

24. The retroreflective road marker system of claim 14 wherein the height of said frusto-conical portion of said stiff resilient body above said planar peripheral ring is not greater than the radius of the base of said frusto-conical portion.

25. A method of installing a retroreflective road marker system having a stiff resilient body of thermoplastic elastomer material adaptable to production in various colors with a continuous peripheral rim, a planar peripheral portion, a central frusto-conical portion, one or more open base cavities, a plurality of vertical apertures extending from said base cavities into said frusto-conical portion, a central vertical aperture penetrating said body, one or more horizontal apertures extending into said frusto-conical portion each to receive a retroreflector and lens element; one or more retroreflector and lens elements each including retroreflector means adaptable to production in various colors and having at least one open chamber in interconnection with at least one of said one or more open base cavities when said retroreflector and lens element is received in said one or more horizontal apertures in said body; and elongate attachment means to be received in said central vertical aperture; comprising the steps of;

selecting a road marker body of appropriate configuration and color for the intended use;

selecting retroreflector and lens element or elements consistent with the configuration of said road marker body selected, and having appropriate reflector color or colors for the intended use;

inserting each retroreflector element into one said horizontal aperture until the outer or lens surface of said element is flush with the outer surface of said frusto-conical portion of said body and said element is firmly and fully seated into said horizontal aperture;

inverting said body with said element or elements received therein and filling said plurality of vertical apertures, said open chamber of each of said retroreflector and lens elements, and said one or more open base cavitites with a suitable adhesive compound, providing for a positive interlock between said stiff resilient body and said retroflector and lens elements and with the road surface upon which said road marker is to be installed, upon curing of said adhesive compound;

reinverting such prepared road marker and placing said road marker in the desired location upon the road surface;

selecting an elongate attachment means appropriate for the road surface to which said road marker is to be installed;

inserting said elongate attachment means in said central vertical aperture of said body; and driving said elongate attachment means into said road surface until the top thereof is in alignment with the top surface of said frusto-conical portion of said body and said body is firmly afixed to said road surface.

* * * * *